US012268349B2

(12) United States Patent
Buogo et al.

(10) Patent No.: US 12,268,349 B2
(45) Date of Patent: Apr. 8, 2025

(54) DOSING UNIT, WATER BEARING HOUSEHOLD APPLIANCE AND METHOD

(71) Applicants: RECKITT BENCKISER (BRANDS) LIMITED, Berkshire (GB); BSH HAUSGERÄTE GMBH, Munich (DE)

(72) Inventors: Alberto Buogo, Hull (GB); Jakob Schultz, Munich (DE); Alexander Schiele, Munich (DE); Henry Matthew Lawrence Fletcher, Cambridgeshire (GB); Iain Christopher Smith, Cambridgeshire (GB); Joshua Carr, Cambridgeshire (GB); Jelmer Jeroen Kuiper, Enschede (NL); Bram Alexander Norp, Enschede (NL); Edwin Petrus Elisabeth Van Opstal, Enschede (NL); Gerhard Jan Pape, Enschede (GB)

(73) Assignees: Reckitt Benckiser (Brands) Limited, Slough (GB); BSH Hausgeräte GMBH, Munich (DE)

( * ) Notice: Subject to any disclaimer, the term of this patent is extended or adjusted under 35 U.S.C. 154(b) by 567 days.

(21) Appl. No.: 17/617,719

(22) PCT Filed: Jul. 3, 2020

(86) PCT No.: PCT/EP2020/068898
§ 371 (c)(1),
(2) Date: Dec. 9, 2021

(87) PCT Pub. No.: WO2021/004971
PCT Pub. Date: Jan. 14, 2021

(65) Prior Publication Data

US 2022/0233052 A1 Jul. 28, 2022

(30) Foreign Application Priority Data

Jul. 9, 2019 (EP) ..... 19185118
Jul. 9, 2019 (GB) ..... 1909824

(51) Int. Cl.
*A47L 15/00* (2006.01)
*A47L 15/44* (2006.01)
(Continued)

(52) U.S. Cl.
CPC ..... *A47L 15/4463* (2013.01); *A47L 15/00* (2013.01); *A47L 15/0015* (2013.01);
(Continued)

(58) Field of Classification Search
None
See application file for complete search history.

(56) References Cited

FOREIGN PATENT DOCUMENTS

CN 104264422 A 1/2015
DE 19540958 A1 5/1997
(Continued)

OTHER PUBLICATIONS

Combined Search and Examination Report dated Jan. 7, 2020, in GB App No. GB1909824.3, filed Jul. 9, 2019.
(Continued)

*Primary Examiner* — Levon J Shahinian
(74) *Attorney, Agent, or Firm* — Dunlap Codding, P.C.

(57) ABSTRACT

A dosing unit for use in an automatic dosing system of a water-bearing household appliance, for automatically dosing a dosing amount of a solid detergent, the dosing unit comprising a dosing cartridge for storing a bulk of the solid detergent and a dosing device for separating the dosing amount from the bulk and releasing the separated dosing amount by linearly displacing a sliding element from a separating position to a release position, wherein the dosing device includes a dosing channel, wherein, when the sliding element is in the separating position, the dosing channel is configured for receiving at least the dosing amount from the bulk and intermediately storing the dosing amount in a pre-dosing position, and, when the sliding element is in the release position, the dosing device is configured for releasing the dosing amount intermediately stored in the pre-dosing position.

20 Claims, 8 Drawing Sheets

(51) Int. Cl.
*D06F 33/37* (2020.01)
*D06F 39/02* (2006.01)

(52) U.S. Cl.
CPC ..... *A47L 15/0055* (2013.01); *A47L 15/4436* (2013.01); *D06F 33/37* (2020.02); *D06F 39/026* (2013.01); *A47L 2501/07* (2013.01)

(56) References Cited

FOREIGN PATENT DOCUMENTS

| | | | |
|---|---|---|---|
| DE | 102007017098 | A1 | 10/2008 |
| FR | 2641764 | A1 | 7/1990 |
| GB | 2557202 | A | 6/2018 |
| JP | 2010136795 | A | 6/2010 |
| WO | 2010013124 | A1 | 2/2010 |
| WO | 2018099897 | A1 | 6/2018 |
| WO | 2018099900 | A | 6/2018 |

OTHER PUBLICATIONS

International Search Report and Written Opinion issued in PCT/EP2020/068898 mailed Oct. 19, 2020.
Decision of Rejection dated Feb. 14, 2025, in Chinese Patent Application No. 2020800432032, filed Jul. 3, 2020.

DOSING UNIT, WATER BEARING HOUSEHOLD APPLIANCE AND METHOD

CROSS-REFERENCE TO RELATED APPLICATIONS

This application is a U.S. National Phase of International Patent Application No. PCT/EP2020/068898, filed on 3 Jul. 2020, which claims priority to United Kingdom Application Serial No. 1909824.3 filed 9 Jul. 2019 and European Application Serial No. 19185118.7 filed 9 Jul. 2019. The entire contents of these applications are incorporated herein by reference in their entirety.

The present invention relates to a dosing unit for use in an automatic dosing system, a water-bearing household appliance, in particular a dishwasher or a washing machine, a method for dosing a dosing amount of detergent and a method operating a water-bearing household appliance.

Known water-bearing household appliances, for example dishwashers, typically have a dosing system, which consists of a chamber for storing a single dose of detergent. The user of the dishwasher has to fill the chamber with the detergent each time before starting a washing cycle. This is inconvenient for the user. Furthermore, such systems bear the risk that the user does not fill in the correct amount of detergent or forgets to fill in detergent at all. This can lead to bad or undesirable cleaning results. It is desired that an automatic dosing system is available, which automatically doses the correct amount of detergent at the correct timings during a washing cycle.

It is one objective of the invention to improve the dosing of detergent in a household appliance.

According to a first aspect, a dosing unit for use in an automatic dosing system of a water-bearing household appliance for automatically dosing a dosing amount of a solid detergent is suggested. The dosing unit comprises a dosing cartridge for storing a bulk of the solid detergent and a dosing device for separating the dosing amount from the bulk and releasing the separated dosing amount by linearly displacing a sliding element from a separating position to a release position. The dosing device includes a dosing channel, wherein, when the sliding element is in the separating position, the dosing channel is configured for receiving at least the dosing amount from the bulk and intermediately storing the dosing amount in a pre-dosing position, and when the sliding element is in the release position, the dosing device is configured for releasing the dosing amount intermediately stored in the pre-dosing position.

The dosing unit may favorably be used in a water-bearing household appliance, in particular a dishwasher or a washing machine, for providing detergent for multiple treatment cycles, without the need to fill in detergent before each cycle. Preferably, the dosing unit can be actuated automatically, for example by a control unit of the water-bearing household appliance.

The solid detergent may be any kind of detergent, that is, a chemical formulation that dissolves, at least partially, in a washing liquor for treating articles and is suitable for enhancing the treatment of the articles by the washing liquor. For example, the detergent includes enzymes, a bleaching agent, a softening agent, a rinse aid, and/or further detergents. The solid detergent may be provided in any form, that is, as a powder, as tablets, as pellets, or the like.

For example, the dosing device is attached to an opening or outlet of the storage cartridge, which is arranged such that when the dosing unit is arranged as intended for use in an automatic dosing system, the opening and the dosing device are at a lowest position. This ensures that the gravity acting on the detergent in the storage cartridge can be employed for transporting the detergent towards the dosing device and also out of the dosing device when being released. The dosing device may be snapped onto, clipped to, glued to, welded to, and/or screwed onto the storage cartridge.

The dosing device is implemented for separating a dosing amount of the detergent from the bulk. This means that the dosing device includes a means that allows for taking, from the bulk, the dosing amount. It does not necessarily mean that the dosing amount is physically separated from the bulk when it is intermediately stored in the dosing channel, but it is arranged such that the separated dosing amount forms the part of the detergent that will be dosed the next time when the dosing unit is actuated for dosing. For example, the dosing amount includes between 0.5 g to 15 g of detergent. In particular, when the detergent is provided in form of detergent tablets, the dosing amount may be exactly one detergent tablet.

The sliding element is arranged in the dosing device movably between two positions, the separating position and the release position. Thus, the position of the sliding element is indicative for a current operational state of the dosing device or the dosing unit. The sliding element is preferably operable by an external driving unit implemented for actuating the dosing unit. For example, the sliding element is arranged at least partially in the dosing channel. In embodiments, the sliding element and the dosing channel may be formed integrally.

In the separating position, the storage cartridge is preferably closed impermeably for fluids of all kinds, in particular humidity, such that the detergent stored in the storage cartridge does not deteriorate prematurely. Also, in the separating position, detergent from the bulk may move into the dosing channel if there is a free space. This may be called refilling the dosing channel in the following. This refilling is particularly driven by gravity. However, in embodiments, there may be elements assisting in the refilling.

The dosing channel is configured for receiving at least the dosing amount of detergent. Thus, the dosing channel includes a volume suitable for taking up the dosing amount. In particular, the volume of the dosing channel may be used for setting the dosing amount. Further, the dosing channel stores the at least one dosing amount intermediately, wherein one dosing amount is arranged in a pre-dosing position. The pre-dosing position is characterized in that the detergent that is intermediately stored in this position will be released in the next dosing, while any further detergent, even if stored intermediately in the dosing channel, will not be released.

When the sliding element is moved to the release position by being linearly displaced from the separating position, the dosing amount is released from the pre-dosing position in the dosing channel. For example, the sliding element displaces a cap for sealing an outlet of the dosing device, thus clearing the outlet such that the dosing amount is released and falls out from pre-dosing position of the dosing channel. At the same time, the sliding element can engage a blocking mechanism for holding back any further detergent in the dosing channel. Then, by moving the sliding element back to the separating position, the cap returns to its closed position in which it seals the storage cartridge and the blocking mechanism disengages, thus allowing the pre-dosing position to be filled with the dosing amount for the next dosing.

The dosing unit may comprise several elements, such as the dosing device and the dosing cartridge, even if not mentioned explicitly. The elements of the dosing unit are preferably made from polymeric materials which are suitable for injection molding. Additionally, the elements may be made from metal and/or a composite material and/or the elements may be coated.

The dosing unit has the advantage that it can be manufactured at low cost, such that when the dosing cartridge runs empty of the detergent, the whole dosing unit can simply be replaced. A refilling of the dosing cartridge may be possible, but is not necessary. It can be very convenient for a user of the water-bearing household appliance with the automatic dosing system to simply replace the whole dosing unit, which may be provided with different kinds of detergent for different applications or different treatment programs.

According to an embodiment of the dosing unit, the dosing channel is configured for receiving and intermediately storing a plurality of dosing amounts.

For example, the dosing channel has a volume sufficient for intermediately storing five times the dosing amount. Preferably, the dosing channel has a geometry that is suitable for lining up the plurality of dosing amounts in a row or pile. For example, the dosing channel has a tube-like shape with a tapered section or a funnel on the top for guiding the detergent. For example, the dosing amount in the pre-dosing position is at a lowest position, and above the dosing amount in the pre-dosing position a number of dosing amounts is piled up, such that one can assign numbers to the dosing amounts that are next in line. In is noted that in case of a detergent that is not provided in form of solid bodies, such as tablets, where one dosing amount may correspond to one tablet, but is rather of an amorphous consistence, the dosing amount may correspond to a certain volume of the dosing channel, which corresponds to the pre-dosing position. Detergent that is not included in that volume is not in the pre-dosing position and will not be released.

According to a further embodiment of the dosing unit, the dosing device includes a blocking mechanism for holding back detergent intermediately stored in the dosing channel different to the dosing amount intermediately stored in the pre-dosing position when the sliding element is in the release position.

The blocking mechanism may be implemented in different ways depending on the form of the detergent. For example, when the detergent provided has an amorphous consistence, such as powder or small pellets, the blocking mechanism may be implemented as an iris diaphragm.

When the detergent is provided in form of tablets that may be gripped individually, the blocking mechanism may be implemented similarly to a tweezer. For example, the blocking mechanism may be formed integrally with the sliding element. The blocking mechanism preferably includes at least one elongated structure, such as a leg, that has a resting position and a holding position. In the holding position, the structure reaches into the dosing channel and applies a pressing force on the detergent tablet above the detergent tablet in the pre-dosing position. This pressing force is sufficient for holding the detergent tablet tight, such that the dosing channel is blocked by the detergent tablet. The blocking mechanism is functionally combined with the sliding element such that when the sliding element is in the separating position, the structure is in its resting position, and when the sliding element is moved into the release position, the structure is actuated and brought into the holding position. Preferably, the structure is made from an elastic material in such way that in the resting position the structure is relaxed, and in the holding position the structure is elastically deformed by a force such that it will automatically relax into the resting position after the force is released.

According to a further embodiment of the dosing unit, the dosing cartridge includes a container having an inclined bottom side with respect to a horizontal direction when the dosing unit is oriented as intended for use and an outlet arranged at a lowest position of the container in this orientation.

In this embodiment, a gravitational force on the bulk of solid detergent stored in the dosing cartridge includes a force component that is directed towards the outlet.

Preferably, the dosing device is attached to the storage cartridge such that the dosing channel is connected to the outlet. In this embodiment, the gravity acting on the detergent is employed for refilling of the dosing channel with detergent. For example, the inclined bottom side includes an angle of between 85° to 60° with the gravitational vector, corresponding to an angle of 5° to 30° with the horizontal direction. A gravitational force acting on a particle with mass m residing on the inclined bottom is given as $F_g=m\cdot g$, where g is the local gravitational acceleration (on earth's surface of the order of 9.81 $m/s^2$). The force component acting towards the dosing device, that is, parallel to the inclined bottom side, is given as $F_p=F_g\cdot\sin$ (inclination angle).

A larger inclination angle results in a larger force component, which assists in moving of the detergent towards the dosing device. However, it also increases a total force acting parallel to the inclined bottom side on the foremost portion of detergent at the dosing device, which can become stuck, leading to a blocking of the dosing device or a malfunction of the dosing unit. Therefore, the inclination angle is preferably selected as a function of the frictional properties of the detergent in the storage cartridge.

In embodiments, an optimum angle allows for easily moving the detergent while reliable operation of the dosing unit is secured. Preferably, in the case of detergent tablets, the inclination angle is chosen such that the detergent tablets do just not slide off the bottom side only from gravity alone. Then, little agitation is sufficient to move the detergent tablets.

According to a further embodiment of the dosing unit, the storage cartridge includes a container having a shape of a cylinder with elliptical cross section, which is oriented, when the dosing unit is oriented as intended for use, such that a gravitational vector is parallel to a side wall of the container.

The term parallel as used in this case means that an angle between the side wall and the gravitational vector is less than 20°, less than 30°, or less than up to 45°.

This shape of the container is particularly useful when the detergent is provided in form of larger solid bodies. Such bodies might block each other from moving, for example they might become locked by forming bridges between two opposite walls of the container. The for such locking is particularly high when the container has parallel walls. An elliptic shape has parallel opposing sides only across its half-axes, which tremendously reduces the risk of bridging.

According to a further embodiment of the dosing unit, the container has taper section in which the container tapers towards an outlet arranged at a lowest position of the container when the dosing unit is oriented as intended for use.

In this embodiment, the detergent is directed towards the outlet by the taper section, which can be implemented as a funnel, for example, which assists in filling of the dosing channel with detergent. In this embodiment, the gravity acting on the detergent is employed for refilling of the dosing channel with detergent, as was described above. For example, an angle between the taper section with respect to a horizontal plane when the dosing unit is arranged as intended for use, is between 20°-80°. As described before, the angle determines the force component acting towards the outlet and thus towards the dosing device. In preferred embodiments, said angle is chosen such that a sliding movement of the detergent takes place automatically, that is, driven by gravity alone.

According to a further embodiment of the dosing unit, the dosing unit includes a cap for sealing the dosing unit when the sliding element is in the separating position.

This is preferred because the detergent may be sensitive to environmental conditions, in particular humidity. Preferably, the cap seals the dosing unit impermeably to fluids of all kinds. For example, the cap and/or the dosing device may include sealing elements for this purpose.

According to a further embodiment of the dosing unit, the dosing cartridge or the dosing device has a deflection element for carrying a weight of a part of the solid detergent of the bulk arranged vertically above the deflection element when the dosing unit is oriented as intended for use, wherein the deflection element is arranged inside the dosing cartridge vertically above an outlet of the storage cartridge when the dosing unit is oriented as intended for use.

In this embodiment, the weight of the detergent that is arranged vertically above the outlet of the storage cartridge does not rest on the outlet. For example, the dosing device is attached to the outlet, such that the deflection element is likewise arranged vertically above the dosing device. The weight of the detergent results in a pressure that increases with increasing height of the detergent pile above deflection element. The deflection element can therefore be considered as a pressure relief unit. Thus, operation of the dosing device is not affected by such a pressure, which increases the reliability of dosing of the dosing amount with the dosing unit. In this embodiment, the detergent essentially has to move slightly laterally to reach under the deflection element and into the dosing channel.

According to a further embodiment of the dosing unit, the dosing cartridge includes a coupling element for coupling to an external agitation unit for agitating at least the storage cartridge.

This embodiment is particularly useful to agitate the detergent in the storage cartridge to assist in refilling of the dosing channel after release of a dosing amount. The external agitation unit is, for example, implemented in an automatic dosing system of a water-bearing household appliance. The agitation unit may be configured for shaking, rattling, vibrating, poking, or the like, of at least the storage cartridge via the coupling element. For example, the agitation unit is implemented as an eccentric or a vibration unit. The coupling element can be implemented as a pin that engages with an eccentric, for example, or a contacting surface for contacting the vibration unit such that mechanical vibrations are transferred to bulk. Such vibration unit may be configured to provide mechanical vibrations having different characteristics, such as direction, frequency and/or amplitude. Preferably, the characteristics are selected depending on the kind and form of detergent to be dosed. Further, the characteristics may be selected depending on a level of detergent in the storage cartridge.

This embodiment is particularly useful in combination with a container having an inclined bottom side having an inclination angle such that a sliding movement of the detergent does not happen automatically. By quickly moving the storage cartridge or by coupling mechanical vibrations into the detergent, the detergent particles are agitated. The inclined bottom side acts as a directional element in this case, which introduces a preferred direction into the movement of the agitated particles, which is the direction along a gradient of the inclined bottom side. This directs the detergent particles towards the dosing device.

According to a further embodiment of the dosing unit, the sliding element is configured for poking upwards into the bulk for loosening the bulk.

This embodiment is particularly efficient in loosening the bulk, such that the bulk remains in a condition in which it is pourable. This assists in refilling of the dosing channel by gravity. Particularly, in embodiments when the detergent is provided in form of tablets, a bridging of detergent tablets between two side walls of the storage cartridge can be released by pushing on the bridged detergent tablets from below, against the gravity acting on the detergent tablets. Furthermore, a force acting on the detergent tablets for such release is relatively weak, such that a risk of breaking a tablet is low.

In this embodiment, the separating position may be considered an intermediate position between the release position and an upwardly extended or poking position of the sliding element.

This embodiment is particularly useful in combination with a storage cartridge having a taper section. Then, preferably, the sliding element is configured for poking into the container over a full width of the taper section, because there is a relatively high risk of bridging of detergent tablets in the taper section.

In further embodiments, the sliding element has a pointing tip for displacing detergent sideways during an upward movement and/or a catching element configured for catching detergent when poking upwards, such that detergent is actively provided to the dosing channel.

According to a further embodiment of the dosing unit, the solid detergent is provided in form of detergent tablets.

The detergent tablets are preferably provided as formed bodies comprising a specific detergent formulation and having a specific size and geometry. The detergent tablets preferably comprise one or more active ingredients for an automatic washing process. As will be appreciated by the skilled person, the nature of the active ingredient(s) used in the detergent tablets will vary depending on the desired application. When used inside a dishwasher, the detergent tablets may, for example, comprise an active ingredient performing a dishwasher detergent, rinse aid, machine cleaner or dishwasher deodorizing function. In the context of laundry washing machines, the detergent tablets may, for example, comprise an active ingredient performing a laundry detergent or fabric softener function. Suitable active ingredients will be known to the skilled person; examples include bleach, bleach activator, bleach catalyst, enzyme, surfactant, builder, pH-adjusting agent, corrosion inhibitor, and fragrance.

For example, each detergent tablet contains a unit dose of the active ingredient, i.e. the entire amount of the active ingredient desired to be used in the washing process, such that only one detergent tablet of that active ingredient needs to be dispensed per washing process. In other embodiments, it may be an advantage for the unit dose of the active ingredient to be provided by more than one detergent tablet. For example, in some cases a single detergent tablet containing the entire unit dose may be rather large or heavy, and dosing may be more effective or reliable using multiple smaller or lighter detergent tablets. Preferably, the desired dose of the active ingredient is provided by no more than 10 detergent tablets, preferably no more than 9, 8, 7, 6, 5, or 4 detergent tablets. Preferably, the unit dose is provided by 1, 2, 3 or 4 detergent tablets. Another useful option is to provide detergent tablets each of which contains an amount of active ingredient that corresponds to no more than one unit dose of the active ingredient for at least one washing process of the automatic washing machine. For example, the dishwasher or washing machine is configured to allow selection between various different modes of operation, such as an intensive wash program and a light wash program, which require different amounts of the active ingredient. Thus, a number of detergent tablets may be dosed during one mode of operation and a different number of detergent tablets are dosed during a different mode of operation. For example, one detergent tablet may be dosed during a wash program for a certain soiling level and two detergent tablets during a wash program designed for a higher level of soiling. The detergent tablets may be of any suitable form, such as solid, gel tab, or water soluble package/container (preferably of low deformability). Preferably, at least the exterior of the detergent tablets are solid. For example, a capsule of a dissolvable (preferably hard) shell material could enclose a powder, liquid or gel composition. Advantageously, however, the detergent tablets are formed of a compressed powder. Each detergent tablet may, for example, be single phase or multi-layered, and may be otherwise structured to ensure that each active ingredient is released from the detergent tablet at the most optimal time. The detergent tablets may be wrapped in a film of water-soluble material, but preferably they are unwrapped. They may be coated with a suitable coating, e.g. to reduce friability. The detergent tablets may be of any suitable shape, such as cylindrical, disc-shaped, spherical, spheroidal, or cuboid. In an embodiment, each detergent tablet has at least one flat face. Preferably, the detergent tablets are cylindrical or disc-shaped, since spherical detergent tablets are more difficult to manufacture whilst shapes such as cuboid are less easily dispensed. In the case of a cylindrical detergent tablet, preferably the length of the tablet is up to 5% more or less than the diameter of the detergent tablet. When the detergent tablet has edges, preferably at least some of these edges are chamfered and/or filleted to reduce the liability to chip during manufacture and whilst the detergent tablet is in the dosing device. Preferably the chamfer has an angle of 15 to 20 degrees.

In an embodiment, each detergent tablet has a weight of: at least 0.1 g, at least 0.5 g, at least 0.7 g, at least 1 g, at least 1.2 g, at least 1.5 g, at least 2 g, at least 3 g, at least 4 g, or at least 5 g; and/or up to 15 g, up to 14 g, up to 13 g, up to 12 g, up to 1 1 g, up to 10 g, up to 9 g, up to 8 g, up to 7 g, or up to 6 g. In an embodiment, each detergent tablet has a maximum length and/or diameter of: at least 5 mm, at least 6 mm, at least 7 mm, at least 8 mm, at least 9 mm, or at least 10 mm; and/or up to 20 mm, up to 19 mm, up to 18 mm, up to 17 mm, up to 16 mm, or up to 15 mm.

Preferably, the detergent tablets are formed such that a high storage density in the storage cartridge can be achieved and the dosing function of the dosing device is supported. Further, the detergent tablets preferably have a form that is easily produced. For example, the detergent tablets have a cylindrical shape, wherein a diameter and a height of the cylinder have similar dimensions, that is, an aspect ratio is of the order of 0.2-1.

In further embodiments, the dosing amount of detergent corresponds to at least one detergent tablet.

It is preferred that the dosing unit is implemented for dosing exactly one detergent tablet at a time, which allows for a precise control of a total amount of detergent supplied to a water-bearing household appliance during one treatment cycle.

In further embodiments, the dosing channel is configured for receiving a plurality of detergent tablets and intermediately storing them.

This embodiment has the advantage that in order to release or dose more than one detergent tablet, a refilling of the dosing channel with detergent tablets after each dosing is not necessary. This is particularly preferred where the refilling is assisted by an external vibration unit, which is likely to generate unwanted noise when being activated. The frequency of activating the vibration unit for refilling the dosing channel can be reduced in this embodiment. Preferably, one activation per treatment cycle is sufficient, for example at the very beginning of a treatment cycle.

According to a further embodiment of the dosing unit, the dosing channel is configured for aligning the intermediately stored detergent tablets in a line one on top the other when the dosing unit is oriented as intended for use, wherein the lowest detergent tablet is in the pre-dosing position.

For example, the dosing channel has a shape of an extended tube with an inner diameter that is of the order of a diameter of one of the detergent tablets. An opening of the tube facing the storage cartridge, or the storage cartridge, has a tapered or funnel-like shape. Then, the detergent tablets are automatically arranged in the described order, which is a 1-dimensional or line arrangement. Therefore, this embodiment facilitates arranging or sorting of the detergent tablets out of an unordered or chaotic arrangement of detergent tablets in the bulk by a steric restriction and assisted by gravity. The order generated by this is helpful in the function of the blocking mechanism, because the positions which the detergent tablets will reside in when intermediately stored in the dosing channel are well-defined, that is, known a priori, such that the blocking mechanism can be designed accordingly.

According to a further embodiment of the dosing unit, the blocking mechanism includes an elastic clamping element for elastically clamping and holding the detergent tablet arranged directly on top the detergent tablet in the pre-dosing position when the sliding element is in the release position.

In this embodiment, the detergent tablet that is next to the detergent tablet in the pre-dosing position is held back by the clamping element. The clamping element may be implemented similarly to a tweezer. For example, the clamping element may be formed integrally with the sliding element. The clamping element preferably includes at least one elongated structure, such as a leg, that has a resting position and a holding position. In the holding position, the clamping element reaches into the dosing channel and applies a pressing force on the detergent tablet above the detergent tablet in the pre-dosing position. This pressing force is sufficient for holding the detergent tablet tight, such that the dosing channel is blocked by the detergent tablet. The clamping element is functionally combined with the sliding element such that when the sliding element is in the separating position, the clamping element is in its resting position, and when the sliding element is moved into the release position, the clamping element is actuated and brought into the holding position. Preferably, the clamping element is made from an elastic material in such way that in the resting position, the clamping element is relaxed, and in the holding position, the clamping element is elastically deformed by a force such that it will automatically relax into the resting position after the force is released. This embodiment has the advantage that, on one hand, the pressing force exerted by the clamping element is limited and can be tuned such that detergent tablets will not break apart when being clamped, and on the other hand, the clamping element is flexible for holding detergent tablets in different orientation and/or sizes. Particularly, the clamping element is configured for clamping and holding fragments or pieces of detergent tablets which broke apart.

According to a further embodiment of the dosing unit, the sliding element comprises a first and a second element, wherein the first element and the second element are arranged movably relative to one another.

This embodiment is useful for counteracting a jamming of the dosing channel. In particular in the case of detergent tablets, there is a risk that a detergent tablet gets stuck in the dosing channel by wedging. The relative movement of the two elements can release such wedging of detergent tablets.

According to a further embodiment of the dosing unit, the first element and the second element are arranged in a first relative position when the sliding element is in the separating position, and are arranged in a second relative position when the sliding element is in the release position.

In this embodiment, the two elements are moved relative to each other with each dosing, when the sliding element is brought from the separating position to the release position. Preferably, the relative movement of the two elements is implemented such that it assists in releasing the detergent amount intermediately stored in the pre-dosing position.

According to a further embodiment of the dosing unit, the first element is arranged in the dosing channel and the second element extends out of the dosing channel, when the sliding element is in the release position, such that an outlet is cleared allowing for release of the dosing amount.

In embodiments, the second element has an inclined bottom side. Preferably, the inclination angle is set such that detergent will slide of the inclined bottom side driven by gravity alone.

According to second aspect, a method for dosing a dosing amount of solid detergent is suggested. In a first step, at least the dosing amount is separated from a bulk of the solid detergent stored in a storage cartridge by receiving at least the dosing amount in a dosing channel. In a second step, the separated dosing amount is intermediately stored in the dosing channel, wherein at least the dosing amount is arranged in a pre-dosing position. In a third step, a sliding element is slid, that is linearly displaced and moved from a separating position to a release position. In a fourth step, the dosing amount intermediately stored in the pre-dosing position is released from the dosing channel, and in a fifth step, the sliding element is slid from the release position back to the separating position.

This method is preferably performed with a dosing unit according to the first aspect.

According to an embodiment of the method, the step of separating at least the dosing amount comprises agitating the bulk of the solid detergent.

Agitation of the bulk may be performed by an external agitation unit or by an internal agitation unit, such as the poking movement of the sliding element described above. The external agitation unit is implemented for coupling mechanical agitation, such as vibration, into the bulk. The coupling of mechanical vibrations into the bulk may comprise a shaking, a rattling, a poking, or the like, of at least the storage cartridge.

The embodiments and features described with reference to the first aspect of the present invention apply mutatis mutandis to the suggested method for dosing a dosing amount of solid detergent.

It is noted that the described blocking mechanism may be employed independently from the dosing device and for other applications than described within this disclosure.

Thus, as a third aspect of the invention, a separation unit for separating objects by gripping and holding at least one of the objects with at least one gripping element is suggested. The objects may be provided in an unordered arrangement. The separation unit is configured for lining up the objects into a linear arrangement, that is, into a line or row one behind the other. For example, this can be achieved by dragging the objects into a tapered channel or a funnel. For securely separating one object from a plurality of objects, at least two of the objects need to be arranged in such linear arrangement. Then, the second object in the line when counted from a direction in which the objects are transported will be stopped from being transported, such that only the first object is transported further, thus the first object is separated from the remaining objects. The at least one gripping element has a tip or contacting portion for engagement with the object to be gripped and for pressing the object against at least one counteracting element, such that a frictional force between the object and the contacting portion as well as the object and the counteracting element is sufficient for securely holding the object fixed in a gripping position. When the second object is gripped, transport of the first object in the line is possible, but transport of further objects is blocked by the second object.

The gripping element is preferably spring-loaded, such that a maximum force which the gripping element exerts on the object is limited. For example, the gripping element is implemented as a pin which is introduced from a side direction with respect to a moving direction of the line of objects. If the pin reaches into a gap between two objects, it may advance until it reaches the counteracting element. The object is then blocked from moving on and this is also considered as gripping and holding the object, even though the object is not pressed as described before.

The gripping element preferably has a bending portion that allows for elastic deformation of the gripping element. When the gripping element is bent out of a relaxed position by an external force, the bending portion acts as a spring. When the external force is released, the bending portion drives the gripping element back into the relaxed position of the gripping element.

Preferably, the gripping element is made from an elastic material. This has the advantage that, on one hand, the pressing force exerted on the object by the gripping element is limited and can be tuned according to a stability or rigidity of the objects, such that mechanically weak objects, for example pressed detergent tablets, will not be damaged or break apart when being gripped, and on the other hand, the gripping element is flexible for gripping and holding objects in different orientation and/or with different sizes. Particularly, the gripping element is configured for gripping and holding fragments or pieces of objects which broke apart.

In embodiments, the separation unit has two gripping elements that are implemented similarly to two legs of a pair of tweezers. For example, the two gripping elements are arranged on two opposing sides of a hollow tube element, extending essentially parallel to the tube element, and each has a projection section, which may be called a knee, that extends over the outer diameter of the tube. When the hollow tube element is slid into a second hollow tube element having an inner diameter that is only slightly larger than an outer diameter of the hollow tube element, the knee of each gripping element extending over the outer diameter will be forced or pushed in by the wall of the second hollow tube element. The gripping elements are thus bent into the hollow tube element, and a tip of an elongated leg will reach into the hollow tube element. An object placed in the hollow tube element will be gripped by the two gripping elements acting from opposing sides, holding the object in place.

In further embodiments, three of more of these gripping elements may be used. A strength of the grip is particularly dependent on the elastic properties of the material used for the gripping elements or the bending portion. Preferably, the gripping element is in its relaxed position during times when no object is held by the separation unit.

In further embodiments, the gripping element may be swiveled into the path of the objects. For example, the gripping element is rotatably mounted and has a slotted guide system, wherein a pin of an actuation unit is engaged in the slot, such that by moving the pin, the gripping element will perform a predefined swiveling movement.

In further embodiments, the gripping element may be implemented as an elastic connecting part, connecting two rigid structures, which are arranged movably relative to one another. A maximum distance between the two rigid structures is set by a length of the elastic connecting part. However, when the two rigid structures are moved towards each other closer than the maximum distance, the elastic connecting part will bend or bulge from its relaxed position. The bulging connecting part may be implemented such that the bulge acts as the gripping element. For example, the elastic connecting part is implemented as a flat stripe of a plastic material with an essentially rectangular shape such as a leaf spring. When the two rigid structures to which the connecting part is fixed are moved towards each other, the connecting part will bulge into a direction of a surface normal of the rectangular material, which are two essentially opposite directions. One of these directions may be sterically blocked, such that the bulging of the connecting part is well controllable.

The separation unit has the advantage of being flexible for holding objects in different orientations and/or sizes. The separation unit is preferably used for separation of detergent tablets in a dosing unit for use in an automatic dosing system such as the dosing unit described with reference to the first aspect. Particularly, the gripping element is configured for gripping and holding fragments or pieces of detergent tablets which broke apart. Thus, operation of the dosing unit is more reliable.

It is noted that the meaning of the term separating as used with reference to the third aspect may be different to the separating of the dosing amount by receiving the dosing amount in the dosing channel described with reference to the first and second aspect.

According to a fourth aspect, a water-bearing household appliance, in particular a dishwasher or a washing machine, with an automatic dosing system including a dosing unit for automatically dosing a dosing amount of a solid detergent into washing liquor for treating articles is suggested. The dosing unit is configured according to the first aspect. It comprises a storage cartridge for storing a bulk of the solid detergent and a dosing device for separating the dosing amount from the bulk and releasing the separated dosing amount by linearly displacing a sliding element from a separating position to a release position. The dosing device includes a dosing channel, wherein, when the sliding element is in the separating position, the dosing channel is configured for receiving at least the dosing amount from the bulk and intermediately storing the dosing amount in a pre-dosing position, and when the sliding element is in the release position, the dosing device is configured for releasing the dosing amount intermediately stored in the pre-dosing position.

This water-bearing household appliance has the advantage that multiple treatment cycles can be performed without the need that a user fills the detergent for each cycle. Further, a proper amount of detergent can automatically be provided, that is, when articles, such as dishes or clothes, are relatively clean, a small amount may be sufficient, for example a single detergent tablet, and when articles are relatively dirty, a larger amount may be necessary for obtaining a good cleaning result, for example three detergent tablets. Also, timings for dosing detergent tablets may be varied in order to improve a cleaning result.

This can be convenient for a user. When the storage cartridge runs out of detergent tablets, the user can simply refill or replace the storage cartridge or the whole dosing unit.

The embodiments and features described with reference to the first, second or third aspect of the present invention apply mutatis mutandis to the suggested water-bearing household appliance. The definitions and explanations provided in conjunction with the first, second or third aspects apply correspondingly to the fourth aspect.

According to an embodiment of the water-bearing household appliance, the automatic dosing system includes a driving unit for actuating the dosing unit for dosing the dosing amount.

For example, the driving unit is controlled by a control unit of the water-bearing household appliance. The driving unit may be implemented as an electric drive. The driving unit is configured for moving the sliding element between the separating position and the release position. Depending on how the dosing device is configured, the driving unit may be implemented for other driving tasks, for example, for pivoting a cap or for actuating a blocking mechanism implemented in the dosing unit.

According to a further embodiment of the water-bearing household appliance, the automatic dosing system is configured for removably receiving the dosing unit.

This has the advantage that the dosing unit may simply be replaced as a whole when the storage cartridge runs out of detergent.

Preferably, the dosing unit can be placed in the automatic dosing system in exactly one orientation, which secures the operation of the dosing unit.

According to a further embodiment of the water-bearing household appliance, the automatic dosing system includes an agitation unit for agitating at least the storage cartridge and the storage cartridge includes a coupling element for coupling to the agitation unit.

This embodiment is particularly useful to agitate the detergent in the storage cartridge to assists in refilling of the dosing channel after release of a dosing amount. The external agitation unit is, for example, implemented in an automatic dosing system of a water-bearing household appliance. The agitation unit may be configured for shaking, rattling, vibrating, poking, or the like, of at least the storage cartridge via the coupling element. For example, the agitation unit is implemented as an eccentric or a vibration unit. The coupling element can be implemented as a pin that engages with an eccentric, for example, or a contacting surface for contacting the vibration unit such that mechanical vibrations are transferred to bulk. Such vibration unit may be configured to provide mechanical vibrations having different characteristics, such as direction, frequency and/or amplitude. Preferably, the characteristics are selected depending on the kind and form of detergent to be dosed. Further, the characteristics may be selected depending on a level of detergent in the storage cartridge.

This embodiment is particularly useful in combination with a container having an inclined bottom side having an inclination angle such that a sliding movement of the detergent does not happen automatically. By quickly moving the storage cartridge or by coupling mechanical vibrations into the detergent, the detergent particles are agitated. The inclined bottom side acts as a directional element in this case, which introduces a preferred direction into the movement of the agitated particles, which is the direction along a gradient of the inclined bottom side. This directs the detergent particles towards the dosing device.

According to fifth aspect, a method for operating a water-bearing household appliance, in particular a dishwasher or a washing machine, with an automatic dosing system for automatically dosing a dosing amount of a solid detergent into washing liquor for treating articles is suggested. In a first step, a treatment program selected from a plurality of treatment programs is started. In a second step, at least the dosing amount is separated from a bulk of the solid detergent stored in a storage cartridge by receiving at least the dosing amount in a dosing channel. In a third step, the separated dosing amount is intermediately stored in the dosing channel, wherein at least the dosing amount is arranged in a pre-dosing position. In a fourth step, a sliding element is slid, that is linearly displaced and moved from a separating position to a release position. In a fifth step, the dosing amount intermediately stored in the pre-dosing position is released from the dosing channel, and in a sixth step, the sliding element is slid from the release position back to the separating position.

This method is preferably performed with a water-bearing household appliance according to the fourth aspect.

According to an embodiment of the method, the step of separating at least the dosing amount comprises agitating the bulk of the solid detergent.

Agitation of the bulk may be performed by an external agitation unit or by an internal agitation unit, such as the poking movement of the sliding element described above. The external agitation unit is implemented for coupling mechanical agitation, such as vibration, into the bulk. The coupling of mechanical vibrations into the bulk may comprise a shaking, a rattling, a poking, or the like, of at least the storage cartridge.

The embodiments and features described with reference to the first, second, third or fourth aspect of the present invention apply mutatis mutandis to the suggested method for operating a water-bearing household appliance.

Further possible implementations or alternative solutions of the invention also encompass combinations—that are not explicitly mentioned herein—of features described above or below with regard to the embodiments. The person skilled in the art may also add individual or isolated aspects and features to the most basic form of the invention.

Further embodiments, features and advantages of the present invention will become apparent from the subsequent description and dependent claims, taken in conjunction with the accompanying drawings, in which:

In the Figures, like reference numerals designate like or functionally equivalent elements, unless otherwise indicated.

Figure 1:
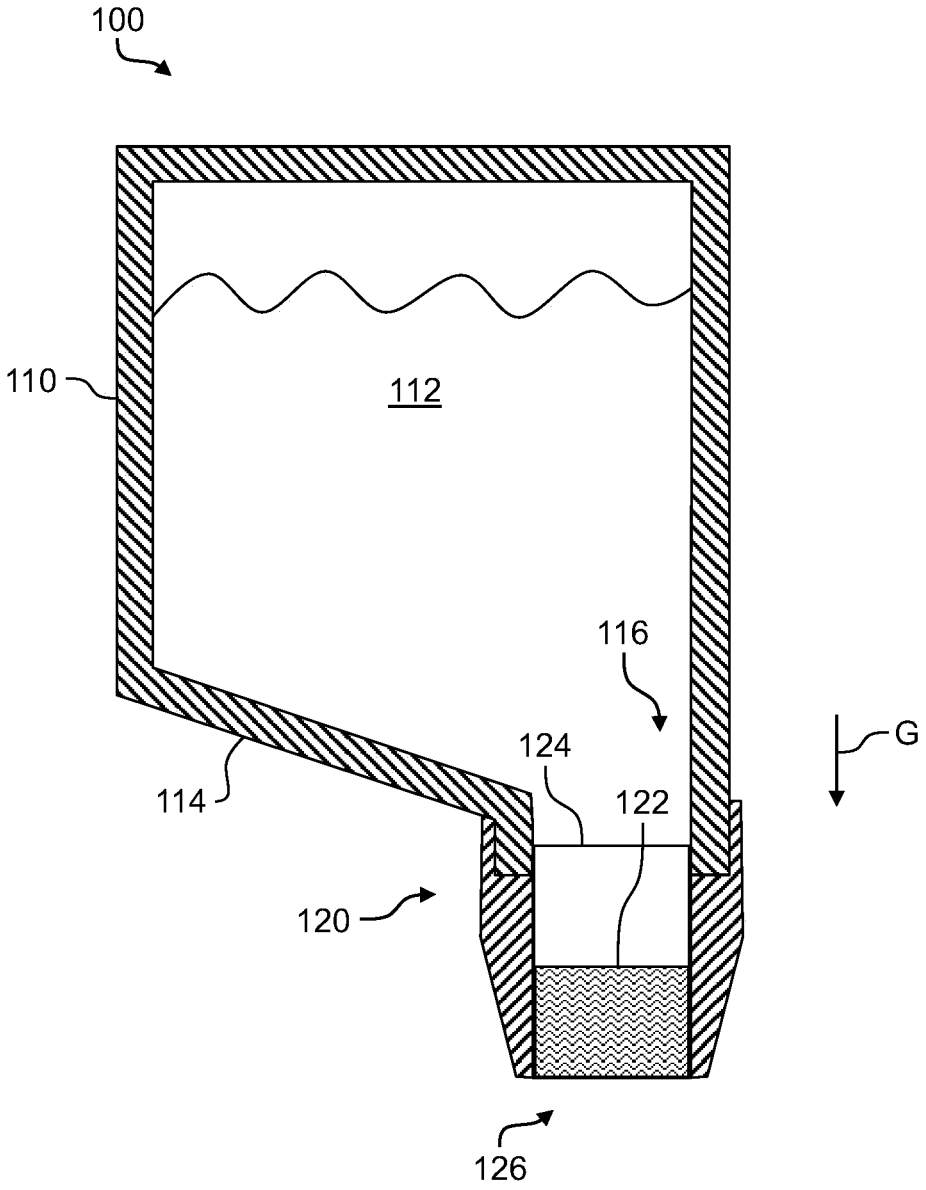
FIG. 1 shows a sectional view of a first example of a dosing unit.

FIG. 1 shows a sectional view of a first example of a dosing unit 100. In this example, the dosing unit 100 is configured for dosing a solid detergent that is provided in the form of a powder or small particles. The dosing unit 100 comprises a storage cartridge 110, which is made from a thermoplastic material and formed by injection molding, for example. The storage cartridge 110 has an essentially trapezoidal shape and stores a bulk 112 of the solid detergent. A bottom side 114 of the storage cartridge 110 is inclined with respect to a horizontal direction when oriented as shown in FIG. 1 with respect to gravity G. An inclination angle between the bottom side 114 and the horizontal direction is 15° in this example and may be selected from a range of 5°-30°. At a lowest section of the storage cartridge 110, an opening or outlet 116 is formed in the storage cartridge 110. Due to the inclination of the bottom side 114, a force component of the gravitational force acting on the detergent resting on the bottom side 114 is directed along a gradient of the bottom side 114, which points towards the outlet 116. A dosing device 120 is attached to the storage cartridge 110 on the outlet 116. The dosing unit 100 is shown in the orientation as intended for use with respect to gravity G.

The dosing device 120 includes a sliding element 124, which is configured for being linearly displaced between a separating position and a release position. Preferably, the dosing device 120 is made from a thermoplastic material and formed by injection molding. However, the dosing device 120 may include elements that are made from other materials, in particular rubber, metal and/or ceramics, such as a sealing element (not shown) arranged between the dosing device 120 and the storage cartridge 110. The dosing device 120 and/or the sliding element 124 form a dosing channel 126. The dosing channel 126 is configured for receiving detergent from the bulk 112 of detergent, particularly when the sliding element 124 is in the separating position, such that the dosing channel 126 is filled with detergent. The detergent in the dosing channel 126 is intermediately stored in the dosing channel 126 until being released. Specifically, the dosing channel 126 includes a volume 122 which may be called a pre-dosing position and which corresponds to a dosing amount of detergent. The dosing amount 122 includes the part of the detergent that is released when the sliding element 124 is moved into the release position.

When used for dosing the dosing amount 122 in an automatic dosing system 20 (see FIG. 3 or 7) of a water-bearing household appliance 1 (see FIG. 3 or 7), the dosing unit 100 is preferably oriented as shown in FIG. 1 with respect to gravity G. In this orientation, gravity G assists in or facilitates both the filling of the dosing channel 126 with detergent from the bulk 112 when the sliding element 124 is in the separating position, as well as in the release of the dosing amount 122 when the sliding element 124 is moved to the release position.

Figures 2A, 2B, 2C:
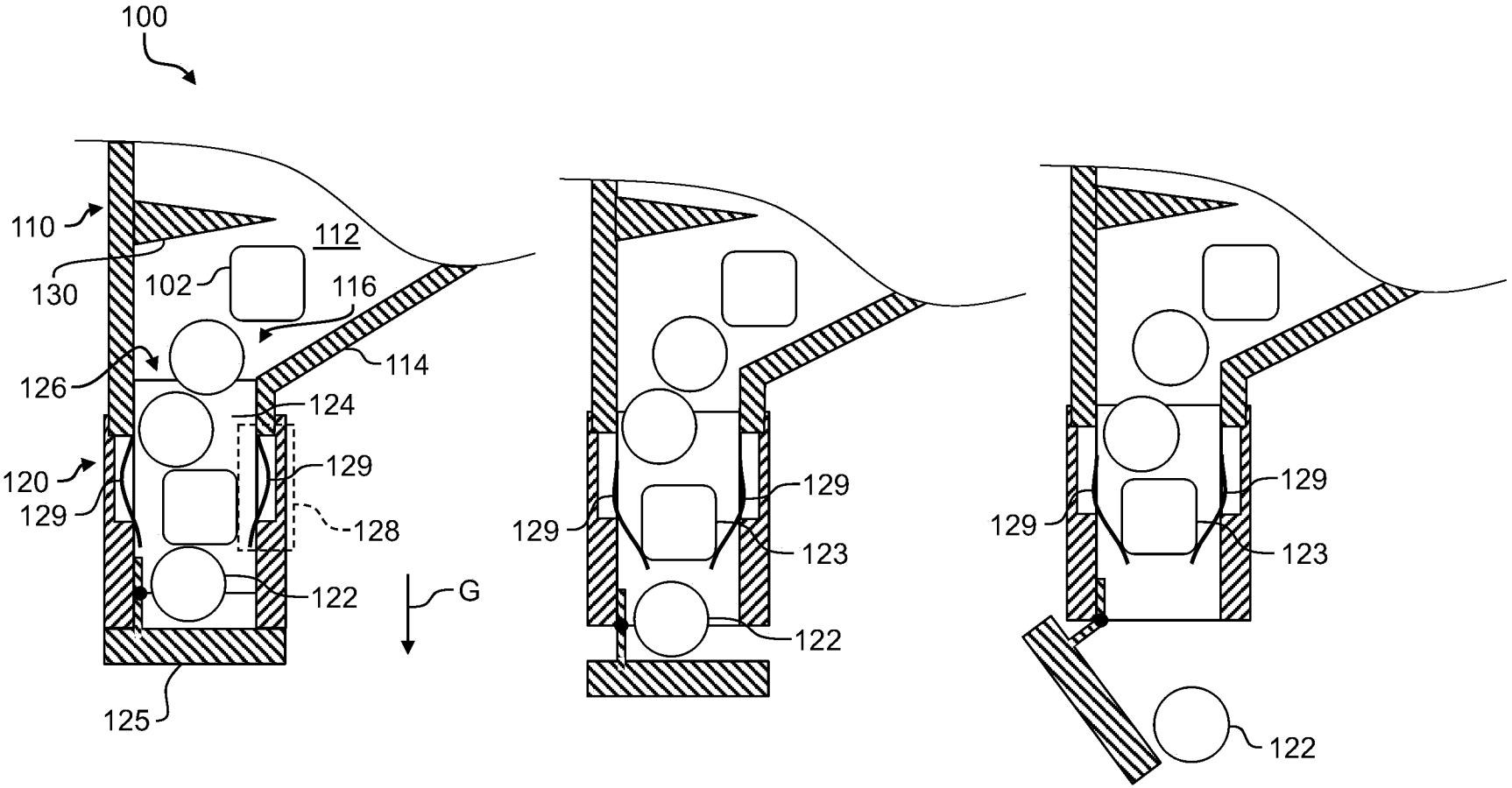
FIG. 2A-2C show a sequence of sectional views of a second example of a dosing unit in different steps of dosing detergent.

FIG. 2A-2C show a sequence of sectional views of a second example of a dosing unit 100 in different steps of dosing a dosing amount 122. In FIG. 2A-2C, the dosing unit 100 is shown only partially in order to provide a detailed view of the dosing device 120. Also, some reference signs of same elements across FIG. 2A-2C are not reproduced in each of the Figs. for better overview. The dosing unit 100 of FIG. 2A-2C is configured for dosing detergent tablets 102, wherein the dosing amount 122 corresponds to exactly one detergent tablet 102. In this example, the dosing device 120 includes a blocking mechanism 128 implemented similar to a pair of tweezers with two elastic clamping elements 129, also referred to as legs in the following. A cap 125 is arranged at a lower end of the dosing channel 126. The cap 125 is configured for closing and sealing the dosing channel 126 such that no fluids may enter the dosing channel 126 and the storage cartridge 110. Further, a deflection element 130 is arranged vertically above the outlet 116 or the dosing device 120. The deflection element 130 is integrally formed with the storage cartridge 110 in this example, but may also be part of the dosing device 120.

FIG. 2A shows the situation when the sliding element 124 is in the separating position. In this state, detergent tablets 102 can travel from the bulk 112 into the dosing channel 126. This movement of detergent tablets 102 is essentially driven by gravity G, but may be assisted, for example by an agitation unit 24 (see FIG. 3 or 7). The deflection element 130 is implemented as a hat and serves as a pressure relief with respect to the dosing device 120 and the detergent tablets 102 that are intermediately stored in the dosing channel 126 or that are about to move into the dosing channel 126. Without this hat 130, a blocking of detergent tablets 102 may occur due to the weight of detergent tablets 102 resting vertically above the dosing device 120. In the separating position, the cap 125 is closed.

The detergent tablets 102 in the dosing channel 126 are sorted or piled up linearly, such that they may be numbered according to at which dosing operation counted from now on they will be released. The lowermost detergent tablet 102 is in the pre-dosing position and forms the dosing amount 122, which will be released the next time the dosing unit 100 is actuated.

FIG. 2B shows an intermediate state of the release or dosing process. For better view, some reference numerals were omitted but are the same as in FIG. 2A. Here, the sliding element 124 was moved a fraction of the total way from the separating position to the release position, for example 50%. In this stage, the legs 129 of the blocking mechanism 128 are already engaged with the detergent tablet 102 that forms the following dosing amount 123, which is arranged directly above the pre-dosing position, holding it back. Note that the number of legs 129 may be one, two, preferably three, or more than three. The cap 125 is still blocking the release of the dosing amount 122, but is not sealed tightly in this stage.

FIG. 2C shows the state when the sliding element 124 is in the release position. For better view, some reference numerals were omitted but are the same as in FIG. 2A. In this state, the cap 125 may swing away from the opening about a hinge formed at one side of the cap 125, is swung away from the opening about a hinge formed at one side of the cap 125, thus releasing the lowermost detergent tablet 102 forming the dosing amount 122. The detergent tablet 102 falls out from the dosing channel 126, driven by gravity G. The pile of detergent tablets 102 intermediately stored in an ordered way in the dosing channel 126 is blocked from falling out by the detergent tablet 102 forming the following dosing amount 123 that is held by the legs 129 of the blocking mechanism 128.

When returning to the separating position, the order of the actions is reversed. That is, first the cap 125 is swung back towards the opening to return to the closed position and then the legs 129 release the detergent tablet 102 forming the following dosing amount 123, such that the pile of intermediately stored detergent tablets 102 in the dosing channel 126 advances by one step. If the detergent tablets 102 stored in the bulk 112 do not move into the dosing channel 126 only by gravity G, an agitating unit 24 (see FIG. 3 or 7) may be activated. However, as long as there are detergent tablets 102 intermediately stored in the dosing channel 126, a number of dosing operations may be performed before a refilling of the dosing channel 126 with detergent tablets 102 becomes necessary.

Preferably, the sliding element 124 is blocked in the separating position by a mechanical restraint element (not shown) when the dosing unit 100 is handled freely. This prevents a simple actuation of the dosing unit 100, for example by pulling with bare hands. When the dosing unit 100 is placed in an automatic dosing system 20 (see FIG. 3 or 7), the mechanical restraint element is disengaged, such that the sliding element 124 is free to be moved. This increases secure handling of the dosing unit 100, in particular by users, because the detergent stored in the storage cartridge 110 may be irritating or harmful, in particular when in contact with skin, the eyes, or mucous membrane.

Figure 3:
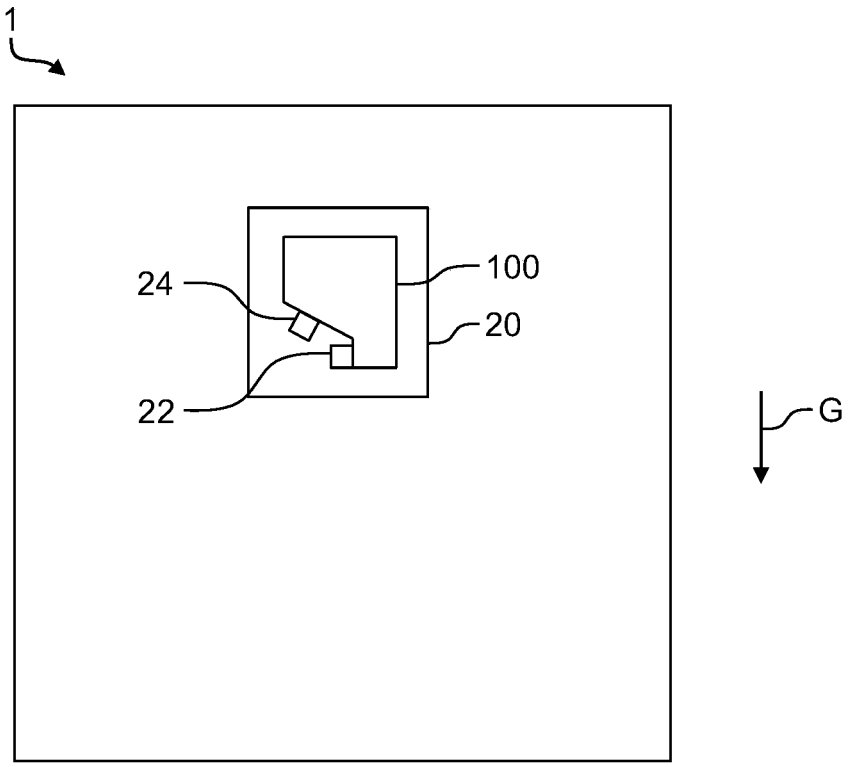
FIG. 3 shows a block diagram of an example of the dosing unit being employed in a water-bearing household appliance.

FIG. 3 shows a schematic block diagram of an example of a dosing unit 100, for example the dosing unit 100 described with reference to FIG. 1, 2, 4 or 5, employed in a water-bearing household appliance 1, for example a dishwasher. The dishwasher 1 includes an automatic dosing system 20, which is implemented for receiving the dosing unit 100. In particular, the automatic dosing system 20 is configured for actuating or operating the dosing unit 100 such that a dosing amount 122 (see FIG. 1, 2, 4 or 5) of solid detergent is dispensed or dosed. For this, the automatic dosing system 20 includes a driving unit 22, which is configured for moving the sliding element 124 (see FIG. 1, 2, 4 or 5) between the separating position and the release position. Preferably, a control unit 15 (see FIG. 7) of the dishwasher 1 controls the operation of the automatic dosing system 20 in accordance with a treatment program. Further, to assist in refilling the dosing channel 126 (see FIG. 1, 2, 4 or 5), an agitation unit 24, implemented as a vibration unit, is arranged in the automatic dosing system 20 such that it is in a mechanical contact with the bottom side 124 of the storage cartridge 110 or with a coupling element implemented for providing a mechanical coupling. The vibration unit 24 is configured to provide mechanical vibrations, which may have different characteristics, such as direction, frequency and/or amplitude. Preferably, the characteristics are selected depending on the kind and form of detergent to be dosed. Further, the characteristics may be selected depending on a level of detergent in the storage cartridge 110.

In this example, the automatic dosing system 20 is arranged on a door of the dishwasher 1. It can be easily accessed by a user for replacing the dosing unit 100 when the storage cartridge 110 runs out of detergent. The automatic dosing system 20 may include a container or case and a second dosing channel (not shown), which separates the dosing unit 100 from the interior of the dishwasher 1, such that the dosing unit 100 is essentially not exposed to the extreme conditions inside the dishwasher 1, in particular high humidity. The released dosing amount 122 is then first dosed into the second dosing channel, and only when the dosing unit 100 is sealed again, the second dosing channel releases the detergent into the dishwasher 1. For refilling the dosing channel 126 with detergent from the bulk 112, the vibration unit 24 is activated. This may generate a rattling sound, which may be perceived as disturbing by a user. Therefore, it is advantageous when the dosing unit 100 and/or the automatic dosing system 20 as a whole are mechanically decoupled from the door of the dishwasher 1. Further, when the dosing channel 126 is implemented for intermediately storing a number of detergent amounts 122, for example a plurality of detergent tablets 102 (see FIG. 2 or 5), it is sufficient to activate the vibration unit 24 after all of the intermediately stored dosing amounts 122 were released.

Figure 4:
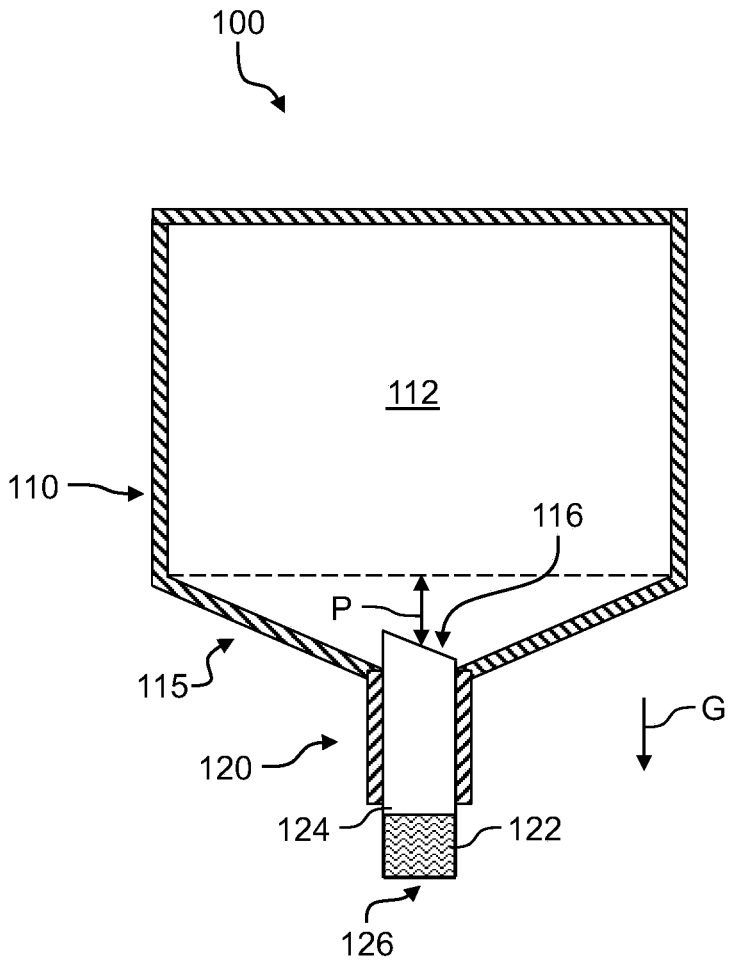
FIG. 4 shows a sectional view of a third example of a dosing unit.

FIG. 4 shows a sectional view of a third example of a dosing unit 100. The dosing unit 100 of this example has a storage cartridge 110 with a cylindrical container having an elliptical cross section, which tapers towards an outlet 116 in a taper section 115. The taper section 115 is implemented as a funnel with elliptic cross section, wherein an angle with respect to a horizontal direction is in the range of 20°-80° in the orientation shown in FIG. 4, which is the orientation as intended for use. The funnel 115 guides the detergent stored in the bulk 112 of detergent in the storage cartridge 110 towards the outlet 116, solely driven by gravity G.

On the outlet 116, a dosing device 120 is attached to the storage cartridge 110. The dosing device 120 includes a sliding element 124 and a dosing channel 126, wherein the dosing channel 126 is configured for receiving and intermediately storing at least one dosing amount 122 of detergent from the bulk 112 via the opening 116. The sliding element 124 is shown in its separating position, in which it essentially extends through the dosing channel 126. The sliding element 124 is configured for being linearly displaced upward through the opening 116 into the bulk 112, as well as downward into a release position.

As shown by arrow P, a poking movement of the sliding element 124 into the bulk 112 is possible, which reaches through the complete tapered section 115 into the storage cartridge 110. The sliding element 124 has an upwardly pointing tip in this example, which helps in poking through the bulk 112 by displacing detergent sideways from the tip. The poking movement of the sliding element 124 has two purposes. First, it agitates the bulk 112 and loosens up the bulk 112, such that it becomes or remains pourable. Second, it assists in refilling of the dosing channel 126 with detergent, by actively "catching" detergent during the upward move of the poking. One can say that the sliding element cuts out detergent from the bulk 112, providing it to the dosing channel 126.

The sliding element 124 may be displaced linearly downward into a release position, in which the dosing amount 122 intermediately stored in the dosing channel 122 is released. When the sliding element 124 is returned to the separating position after release, detergent from the bulk 112 may trickle or move into the space in the dosing channel 126 that was freed during release, driven by gravity G.

Figure 5C:
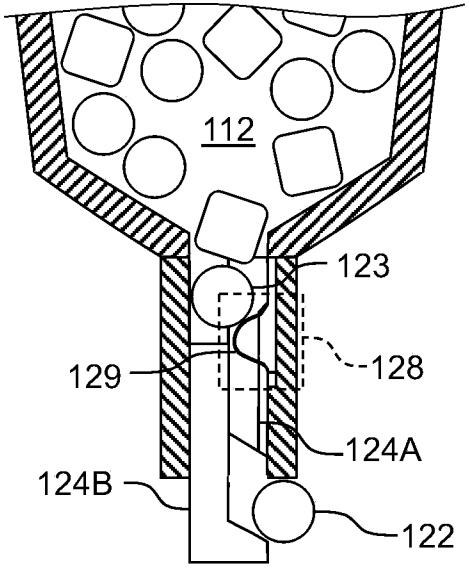
FIG. 5A-5C show a sequence of sectional views of a fourth example of a dosing unit in different steps of dosing detergent.
Figure 5B:
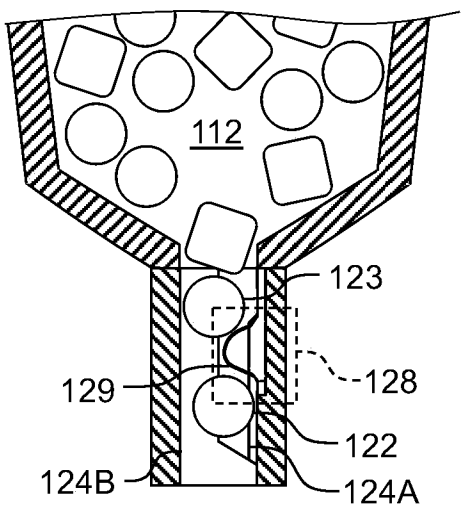
Figure 5A:
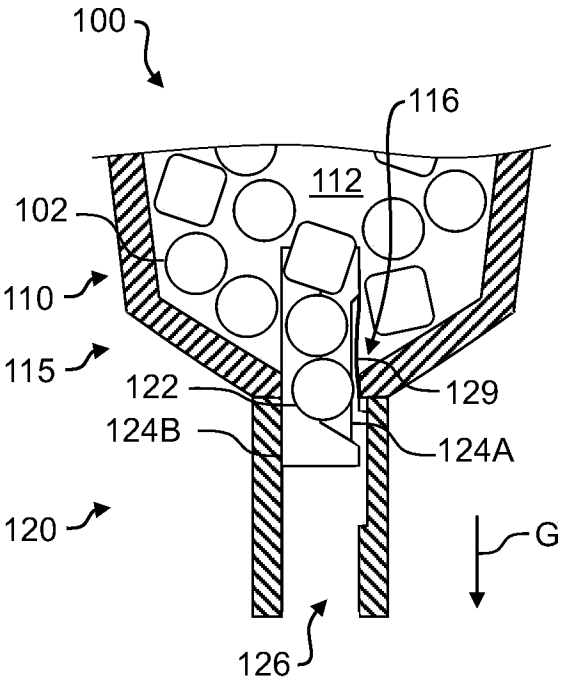

FIG. 5A-5C show a sequence of sectional views of a fourth example of a dosing unit 100 in different steps of dosing detergent. The dosing unit 100 shown here may be used in the automatic dosing system 20 as described with reference to FIG. 3 or 7. In FIG. 5A-5C, the dosing unit 100 is shown only partially in order to provide a detailed view of the dosing device 120. Also, some reference signs of same elements across FIG. 5A-5C are not reproduced in each Fig., for better overview. The dosing unit 100 of FIG. 5A-5C is configured for dosing detergent tablets 102, wherein the dosing amount 122 corresponds to exactly one detergent tablet 102. In this example, the sliding element 124 includes two elements, a first element 124A and a second element 124B. The first element 124A and the second element 124B are attached to each other, but can be linearly displaced relative to each other. The second element 124B has a closing portion at its lower end, which is configured for closing and sealing the dosing channel 126 when the sliding element 124 is in the separating position, as is shown in FIG. 5B. Further, an inner side of the closing portion forms an inclined plane with respect to a horizontal direction. Also, the dosing device 120 includes a blocking mechanism 128, implemented by an elastic clamping element 129 formed on the first element 124A, and a projection formed on the elastic clamping element 129 reaching into a recess formed in the dosing channel 126. When the projection reaches the end of the recess, the clamping element 129 bulges, until movement of the first element 124A is stopped.

FIG. 5A shows the dosing unit 100 during a poking movement of the sliding element 124, in which the first element 124A and the second element 124B are moving upwardly together, reaching into the storage cartridge 110. By the upward move into the bulk 112 of detergent tablets 102, the dosing channel 126 is filled with detergent tablets 102.

FIG. 5B shows the dosing unit 100 when the sliding element 124 is in the separating position. For better view, some reference numerals were omitted but are the same as in FIG. 5A. As can be seen, the elastic clamping element 129 is bulged into the dosing channel 126, thereby clamping or holding the detergent tablet 102 disposed next to the clamping element 129 in the dosing channel 126, which forms the following dosing amount 123. By this, the dosing channel 126 is blocked, that is, detergent tablets 102 above the clamped one cannot move further in the dosing channel 126. One detergent tablet 102 is intermediately stored in the pre-dosing position, forming the dosing amount 122.

FIG. 5C shows the dosing unit 100 when the sliding element 124 is in the release position. For better view, some reference numerals were omitted but are the same as in FIG. 5A. Starting from the separating position, only the second element 124B is moved downward, the first element 124A is held fixed in the same position as shown in FIG. 5B. That is, the first element 124A and the second element 124B are moved relative to each other. Due to this relative movement, detergent tablets 102 or fragments of detergent tablets 102 that are stuck in the dosing channel 126 can be released, increasing the reliability of the dosing unit 100. Further, an outlet is cleared, which allows the detergent tablet 102 to slide off the inclined plane of the closing portion and fall out from the dosing device 120.

Figure 7:
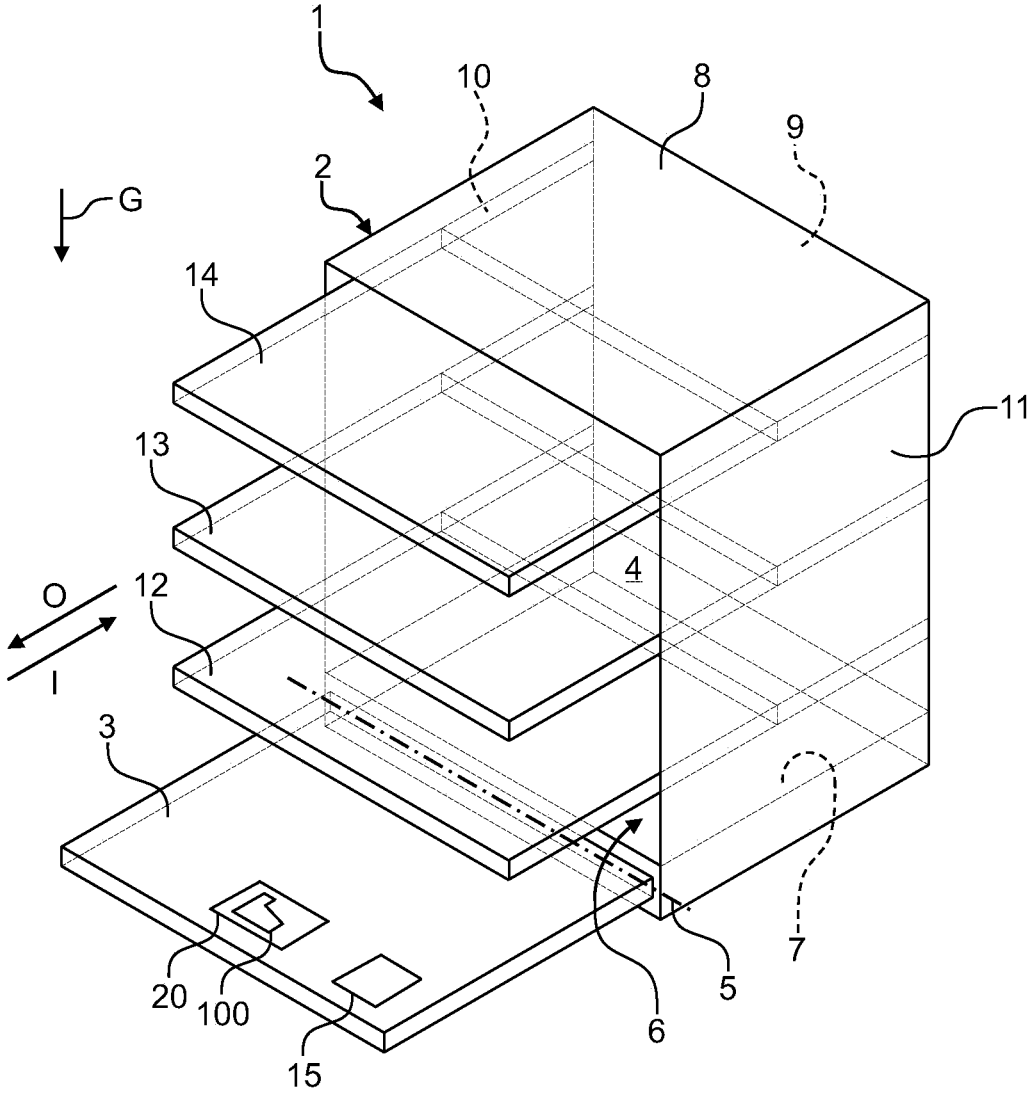
FIG. 7 shows a schematic perspective view of an example of a water-bearing household appliance.

The dosing unit 100 of FIG. 5 is preferably used in an automatic dosing system 20 of a water-bearing household appliance 1 (see FIG. 3 or 7).

Figure 6:
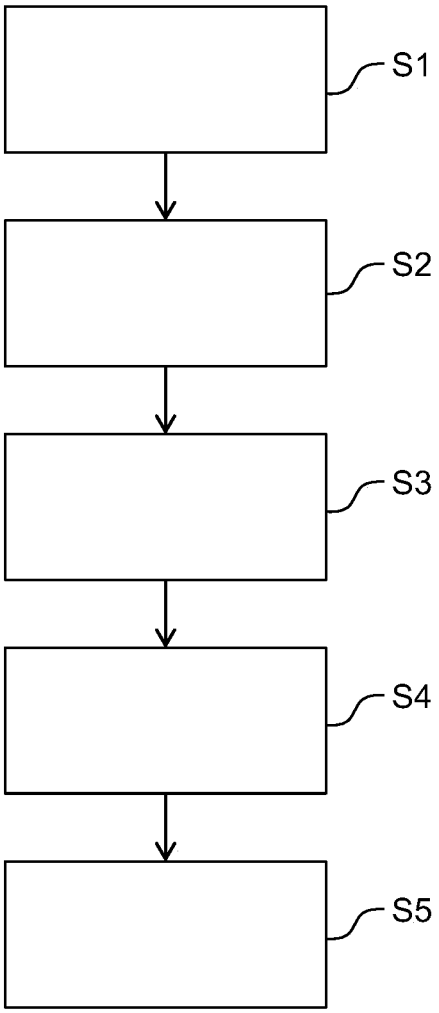
FIG. 6 shows a block diagram of an example of a method for dosing a dosing amount of detergent.

FIG. 6 shows a block diagram of an example of a method for dosing a dosing amount of detergent. In a first step S1, at least the dosing amount 122 (see FIG. 1, 2, 4 or 5) is separated from a bulk 112 (see FIG. 1, 2, 4 or 5) of the solid detergent stored in a storage cartridge 110 (see FIG. 1, 2, 4 or 5) by receiving at least the dosing amount 122 in a dosing channel 126 (see FIG. 1, 2, 4 or 5). In a second step S2, the separated dosing amount 122 is intermediately stored in the dosing channel 126, wherein at least the dosing amount 122 is arranged in a pre-dosing position. In a third step S3, a sliding element 124 (see FIG. 1, 2, 4 or 5) is moved from a separating position to a release position. In a fourth step S4, the dosing amount 122 intermediately stored in the pre-dosing position is released from the dosing channel 126, and in a fifth step S5, the sliding element 124 is moved from the release position back to the separating position.

FIG. 7 shows a schematic perspective view of an example of a water-bearing household appliance 1, which is implemented as a domestic dishwasher. The domestic dishwasher 1 comprises a tub 2, which can be closed by a door 3. Preferably, the door 3 seals the tub 2 so that it is waterproof, for example by using a door seal between door 3 and the tub 2. Preferably, the tub 2 has a cuboid shape. Tub 2 and door 3 can form a washing chamber 4 for washing dishes. The domestic dishwasher 1 is shown in an orientation as intended for use relative to gravitational vector G.

In FIG. 7, door 3 is shown in the open position. By swiveling about an axis 5 at a lower edge of door 3, the door 3 can be opened or closed. With the door 3, an opening 6 of the tub 2 for inserting dishes into the washing chamber 4 can be opened or closed. Tub 2 comprises a lower cover 7, an upper cover 8 facing the lower cover 7, a rear cover 9 facing the closed door 3 and two side covers 10, 11 which face each other. For example, the lower cover 7, the upper cover 8, the rear cover 9 and the two side covers 10, 11 can be made from stainless steel sheets. Alternatively, at least one of the covers, for example the lower cover 7, can be made from a polymeric material, such as plastic.

The domestic dishwasher 1 further has at least one rack 12, 13, 14 on which dishes to be washed can be placed. Preferably, more than one rack 12, 13, 14 is used, wherein rack 12 can be lower rack, rack 13 can be an upper rack and rack 14 can be a rack specific for cutlery. As is shown in FIG. 7, the racks 12 to 14 are arranged vertically above each other in the tub 2. Each rack 12, 13, 14 can be pulled out from the tub 2 in a first, outward direction O or pushed into the tub 2 in a second, inward direction I.

FIG. 7 further shows an automatic dosing system 20 that is arranged in the door 3 of the domestic dishwasher 1. The automatic dosing system 20 comprises a dosing unit 100 that is removably fixed in the automatic dosing system 20. The automatic dosing system 20 has a driving unit 22 (see FIG. 3) configured to actuate the dosing unit 100 for automatically dosing a dosing amount 122 (see FIG. 1, 2, 4, or 5) of solid detergent stored in a storage cartridge 110 (see FIG. 1, 2, 4 or 5) of the dosing unit 100. Preferably, the automatic dosing system 20 may be controlled by a control unit 15, which is implemented for operating the domestic dishwasher 1 according to a treatment program selected from a plurality of treatment programs. Further, in preferred embodiments, the automatic dosing system 20 includes an agitation unit 24 (see FIG. 3) which is configured for agitating at least the storage cartridge 110.

The automatic dosing system 20 is preferably implemented to be operated in conjunction with a dosing unit 100 described with reference to FIG. 1, 2, 4 or 5.

Figure 8:
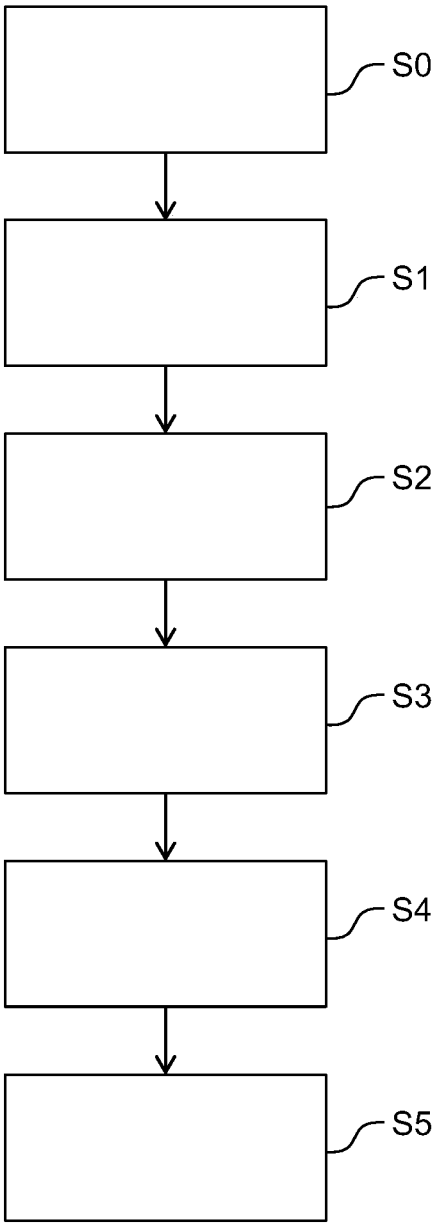
FIG. 8 shows a block diagram of an example of a method for operating a water-bearing household appliance.

FIG. 8 shows a block diagram of an example of a method for operating a water-bearing household appliance 1 (see FIG. 3 or 7) with an automatic dosing system 20, for example the one shown in FIG. 3 or 7. In a first step S0, a treatment program selected from a plurality of treatment programs is started. In a second step S1, at least the dosing amount 122 (see FIG. 2, 3, 5 or 6) is separated from a bulk 112 (see FIG. 2, 3, 5 or 6) of the solid detergent stored in a storage cartridge 110 (see FIG. 2, 3, 5 or 6) by receiving at least the dosing amount 122 in a dosing channel 126 (see FIG. 2, 3, 5 or 6). In a third step S2, the separated dosing amount 122 is intermediately stored in the dosing channel 126, wherein at least the dosing amount 122 is arranged in a pre-dosing position. In a fourth step S3, a sliding element 124 (see FIG. 2, 3, 5 or 6) is moved from a separating position to a release position. In a fifth step S4, the dosing amount 122 intermediately stored in the pre-dosing position is released from the dosing channel 126, and in a sixth step S5, the sliding element 124 is moved from the release position back to the separating position.

Although the present invention has been described in accordance with preferred embodiments, it is obvious for the person skilled in the art that modifications are possible in all embodiments.

REFERENCE NUMERALS

1 water-bearing household appliance
2 tub
3 door
4 washing chamber
5 axis
6 opening
7 lower cover
8 top cover
9 rear cover
10 side cover
11 side cover
12 rack
13 rack
14 rack
15 control unit
20 automatic dosing system
22 driving unit
24 vibration unit
100 dosing unit
102 detergent tablet
110 storage cartridge
112 bulk
114 bottom side
115 taper section
116 outlet
120 dosing device
122 dosing amount
123 following dosing amount
124 sliding element
124A first element
124B second element
125 cap
126 dosing channel
128 blocking mechanism
129 clamping element
130 deflection element
I inward direction
G gravity vector
O outward direction
P poking movement
S1 method step
S2 method step
S3 method step
S4 method step
S5 method step

The invention claimed is:

1. A dosing unit for use in an automatic dosing system of a water-bearing household appliance, for automatically dosing a dosing amount of a solid detergent, the dosing unit comprising:

a storage cartridge for storing a bulk of the solid detergent; and a dosing device for separating the dosing amount from the bulk and releasing the separated dosing amount by linearly displacing a sliding element from a separating position to a release position, wherein the dosing device comprises a dosing channel, wherein, when the sliding element is in the separating position, the dosing channel is configured for receiving at least the dosing amount from the bulk and intermediately storing the dosing amount in a pre-dosing position, and, when the sliding element is in the release position, the dosing device is configured for releasing the dosing amount intermediately stored in the pre-dosing position, and wherein the sliding element is configured for poking upwards into the bulk for loosening the bulk.

2. The dosing unit according to claim 1, wherein the dosing channel is configured for receiving and intermediately storing a plurality of dosing amounts.

3. The dosing unit according to claim 1, wherein the dosing device comprises a blocking mechanism for holding back detergent intermediately stored in the dosing channel different to the dosing amount intermediately stored in the pre-dosing position when the sliding element is in the release position.

4. The dosing unit according to claim 1, wherein the storage cartridge comprises a container having an inclined bottom side with respect to a horizontal direction when the dosing unit is oriented as intended for use and an outlet arranged at a lowest position of the container in this orientation.

5. The dosing unit according to claim 1, wherein the dosing comprises a container having a cylindrical shape with elliptical cross section, which is oriented, when the dosing unit is oriented as intended for use, such that a gravitational vector is parallel to a side wall of the container.

6. The dosing unit according to claim 5, wherein the container has a taper section in which the container tapers towards an outlet arranged at a lowest position of the container when the dosing unit is oriented as intended for use.

7. The dosing unit according to claim 1, wherein the dosing unit comprises a cap configured for sealing the dosing unit when the sliding element (124) is in the separating position.

8. The dosing unit according to claim 1, wherein one of the storage cartridge or the dosing device has a deflection element configured for carrying a weight of a part of the solid detergent from the bulk arranged vertically above the deflection element when the dosing unit is oriented as intended for use, wherein the deflection element is arranged inside the storage cartridge vertically above an outlet of the storage cartridge when the dosing unit is oriented as intended for use.

9. The dosing unit according to claim 1, wherein the dosing unit includes a coupling element configured for coupling to an external agitation unit for agitating at least the storage cartridge.

10. The dosing unit according to claim 1, wherein the solid detergent is provided in form of detergent tablets.

11. The dosing unit according to claim 10, wherein the dosing channel is configured for aligning the intermediately stored detergent tablets in a line one on top of the other when the dosing unit is oriented as intended for use, wherein the lowest detergent tablet is in the pre-dosing position.

12. The dosing unit according to claim 11, wherein the blocking mechanism comprises an elastic clamping element configured for elastically clamping and holding the detergent tablet arranged directly on top of the adjacent detergent tablet in the pre-dosing position forming the dosing amount when the sliding element is in the release position.

13. The dosing unit according to claim 1, wherein the sliding element comprises a first element and a second element, wherein the first element and the second element are arranged movably relative to one another.

14. The dosing unit according to claim 13, wherein the first element and the second element are arranged in a first relative position when the sliding element is in the separating position, and are arranged in a second relative position when the sliding element is in the release position.

15. The dosing unit according to claim 14, wherein, when the sliding element is in the release position, the first element is arranged in the dosing channel and the second element extends out of the dosing channel, such that an outlet is cleared allowing for release of the dosing amount.

16. A water-bearing household appliance comprising an automatic dosing system, the automatic dosing system comprising a dosing unit for automatically dosing a dosing amount of a solid detergent into washing liquor for treating articles, wherein the dosing unit is implemented according to claim 1.

17. The water-bearing household appliance according to claim 16, wherein the automatic dosing system includes a driving unit for actuating the dosing unit for dosing the dosing amount.

18. The water-bearing household appliance according to claim 16, wherein the automatic dosing system is configured for removably receiving the dosing unit.

19. The water-bearing household appliance according to claim 16, wherein the automatic dosing system includes an agitation unit for agitating at least the storage cartridge and the storage cartridge includes a coupling element for coupling to the agitation unit.

20. A method for dosing a dosing amount of solid detergent from a dosing unit (100), the method comprising:

separating at least the dosing amount from a bulk of the solid detergent stored in a storage cartridge by receiving at least the dosing amount in a dosing channel, wherein the step of separating at least the dosing amount comprises agitating the bulk of the solid detergent;

intermediately storing the separated amount of solid detergent in the dosing channel, wherein at least the dosing amount is arranged in a pre-dosing position;

sliding a sliding element from a separating position to a release position;

releasing the dosing amount intermediately stored in the pre-dosing position; and sliding the sliding element from the release position back to the separating position.

* * * * *